US005743050A

United States Patent [19]

Shibata

[11] Patent Number: 5,743,050

[45] Date of Patent: Apr. 28, 1998

[54] TRAINING ROOM SERVING ALSO AS BED ROOM

[76] Inventor: Tsutomu Shibata, 3-10, Nishi 3-chome, Kita 36-jo, Kita-ku, Sapporo-shi, Hokkaido, Japan

[21] Appl. No.: 566,041

[22] Filed: Dec. 1, 1995

[51] Int. Cl.[6] ..... E04H 1/12

[52] U.S. Cl. ..... 52/27; 52/79.1; 482/142

[58] Field of Search ..... 52/36.1, 74.1, 52/27, 36.2; 482/904, 148, 135, 134, 133, 142

[56] References Cited

U.S. PATENT DOCUMENTS

| | | | |
|---|---|---|---|
| 2,061,686 | 7/1936 | Roessler | 482/904 X |
| 3,455,295 | 7/1969 | Kellogg | 482/904 X |
| 3,540,435 | 11/1970 | Smith | 482/904 X |
| 3,826,490 | 7/1974 | Mossman | 482/904 X |
| 4,169,589 | 10/1979 | McArthur | 482/135 X |
| 4,198,044 | 4/1980 | Holappa | 482/142 |
| 4,505,078 | 3/1985 | Huh | 52/36.2 |
| 4,515,361 | 5/1985 | Melillo et al. | 482/904 X |
| 4,594,817 | 6/1986 | McLaren et al. | 52/36.2 |
| 4,679,787 | 7/1987 | Guilbault | 482/904 X |
| 4,679,788 | 7/1987 | Adler | 272/3 |
| 4,913,423 | 4/1990 | Farran et al. | 482/904 X |
| 4,925,184 | 5/1990 | McJunkin, Jr. et al. | 482/904 X |
| 4,934,695 | 6/1990 | Wolff | 482/133 |
| 4,987,706 | 1/1991 | Hughes et al. | 52/79.1 X |
| 4,993,407 | 2/1991 | Chen | 482/133 X |
| 5,031,905 | 7/1991 | Walsh | 482/134 |
| 5,111,626 | 5/1992 | Fortune | 52/79.1 |
| 5,207,628 | 5/1993 | Graham | 482/904 X |
| 5,260,870 | 11/1993 | Tsuchiya et al. | 482/135 X |
| 5,456,649 | 10/1995 | Horkey | 482/904 X |
| 5,542,898 | 8/1996 | Wilkinson | 482/142 |
| 5,562,577 | 10/1996 | Nichols, Sr. et al. | 482/134 X |
| 5,601,518 | 2/1997 | Weintraub | 482/904 X |

FOREIGN PATENT DOCUMENTS

| | | | |
|---|---|---|---|
| 459852 | 12/1991 | European Pat. Off. | 52/79.1 |
| 1408922 | 7/1965 | France | 52/36.1 |
| 2734523 | 2/1979 | Germany | 52/79.1 |
| 403017333 | 1/1991 | Japan | 52/36.1 |
| 403100277 | 4/1991 | Japan | 52/79.1 |
| 403194042 | 8/1991 | Japan | 52/36.2 |
| 404169662 | 6/1992 | Japan | 52/36.1 |

*Primary Examiner*—Michael Safavi

*Attorney, Agent, or Firm*—Sughrue, Mion, Zinn, Macpeak & Seas, PLLC

[57] ABSTRACT

A compact training room or apparatus serving also as a bed room wherein required training can be performed, immediately prior to sleeping, simply and effectively on a bed for sleeping and yet a particularly large space is not required. The training room serving also as a bed room, comprises a sleeping bed, a housing including a floor plate, a plurality of wall plates and a ceiling plate and defining a space in which the sleeping bed is accommodated, and a plurality of training machines located in the space such that a user can selectively use the training machines in order to train the user itself while lying on the sleeping bed with the face turned upwardly or seated on the sleeping bed.

5 Claims, 2 Drawing Sheets

TRAINING ROOM SERVING ALSO AS BED ROOM

BACKGROUND OF THE INVENTION

1. Field of the Invention

This invention relates to a training room or apparatus serving also as a bed room.

2. Description of the Related Art

Owing to recent investigations in the sports medical science and the sports science, it has become known widely that the growth hormone of the human body is secreted actively during non-REM sleep while asleep. Further investigations have revealed that, when heavy-load training is performed for approximately 20 seconds prior to going to bed, the level of the growth hormone in the blood is maintained at a high level for one to two hours after the training.

In other words, if suitable heavy-load training is performed for a suitable period of time immediately before going to bed, then the physical strength can be developed effectively during sleep.

However, in order to perform heavy-load training immediately prior to going to bed, equipment necessary for the training must be installed in the bed room of the individual. However, to ensure a sufficiently large space for the equipment is not practical from the point of view of the housing environment where the space of the house is not very great.

On the other hand, if a person goes to a fitness stadium or the like to perform training, then the problem of installation of equipment in a bed room or the space for the equipment does not arise. However, this is not effective since a predetermined interval of time is required after completion of training before going to bed.

SUMMARY OF THE INVENTION

It is an object of the present invention to provide a compact training room or apparatus serving also as a bed room wherein required training can be performed, immediately prior to sleeping, simply and effectively on a bed for sleeping and yet a particularly large space is not required.

According to the present invention, there is provided a training room serving also as a bed room, comprising, a sleeping bed, a housing including a floor plate, a plurality of wall plates and a ceiling plate and defining a space in which the sleeping bed is accommodated, and a plurality of training machines located in the space such that a user can selectively use the training machines in order to train the user himself or herself while lying on the sleeping bed with the face turned upwardly or seated on the sleeping bed.

With the training room serving also as a bed room, a user can perform various kinds of training while he or she lies with the face turned upward or is seated on the sleeping bed. Consequently, after completion of the training, the user can fall asleep immediately on the sleeping bed, which is effective for the user to develop his or her physical strength. Further, since the training machines are located such that the user can selectively use them while lying on the sleeping bed with the face turned upwardly or seated on the sleeping bed, the training room serving also as a bed room does not require a large space and can be formed compact.

Preferably, the training room serving also as a bed room further comprises an audio/visual apparatus for image training located in the space. Where the audio/visual apparatus is provided, the user can perform various kinds of training while simultaneously performing image training.

The training machines may include an abdominal muscle training foot pillow, a composite training machine for training the arms or other parts of the body of a user, a leg training machine or a back muscle training machine.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Figure 1:
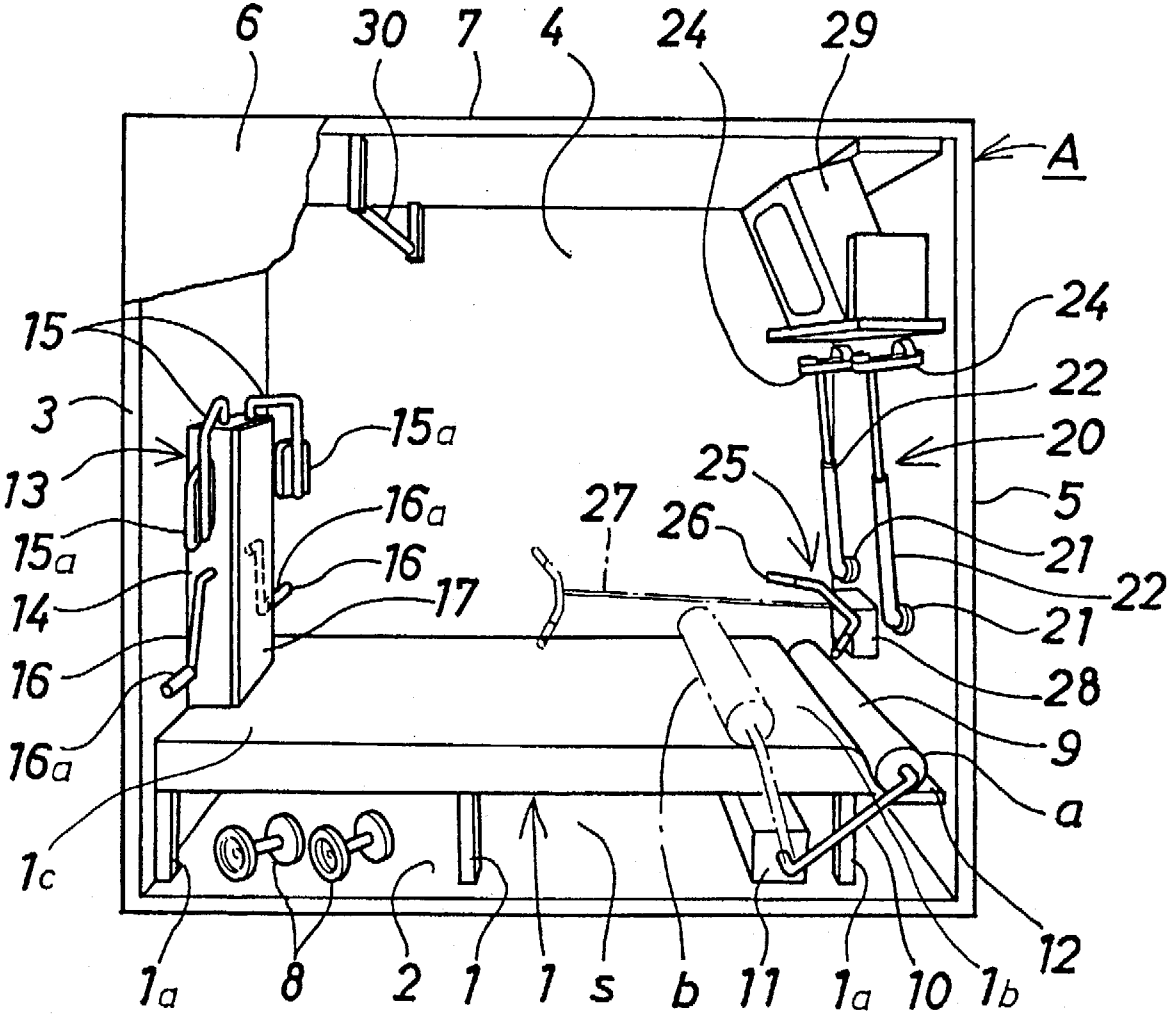
FIG. 1 is a perspective view of a training room serving also as a bed room showing a preferred embodiment of the present invention.

Referring first to FIG. 1, there is shown a training room or apparatus serving also as a bed room according to a preferred embodiment of the present invention. The training room serving also as a bed room is generally denoted at A and includes a floor plate 2 having a sufficient area to allow a sleeping bed 1 to be placed thereon, four wall plates 3 to 6 erected uprightly around the four sides of the floor plate 2, and a ceiling plate 7. The plates 2 to 7 cooperate with each other to form a housing and can be assembled into and disassembled from such a box-like configuration readily as seen in FIG. 1. The plates 2 to 7 may be removably assembled to each other using any suitable means, for example, using a fitting structure between two members or using a removable fastening device such as a bolt and a nut.

The floor plate 2, wall plates 3 to 6 and ceiling plate 7 of the housing are preferably formed from a material or materials having a high noise insulating property.

Though not shown, one or more openings such as a window or an entrance/exit are suitably or selectively formed in the wall plates 3 to 6 while an opening such as a ventilating hole is suitably formed in the ceiling plate 7.

The sleeping bed 1 has a suitable plural number of legs 1*a*, by which it is held spaced away from the floor plate 2 with a predetermined space s left therebetween. Suitable training devices 8 such as, for example, a dumbbell are accommodated in the space s.

A foot pillow 9 for training abdominal muscles is placed at a leg receiving side end portion 1*b* of the sleeping bed 1.

Though not particularly shown, the foot pillow 9 includes a cylindrical core member formed from a resilient material such as a urethane resin and a cover formed from a vinyl sheet or the like and covering over the core member. The foot pillow 9 is supported at and extends between free ends of a pair of left and right rockable arms 10 which are mounted at the other base ends thereof for rocking motion on a frame 11 located in the space s below the sleeping bed 1.

The sleeping bed 1 has an offset portion 12 formed projectingly on the outer side of the leg receiving side end portion 1*b* thereof. The foot pillow 9 can be moved between a position a (indicated by solid lines in FIG. 1) at which it is received on the offset portion 12 and flush with an upper face of the sleeping bed 1 and another position b (indicated by alternate long and short dashes lines in FIG. 1) at which it is received on the upper face of the leg receiving side end portion 1*b* of the sleeping bed 1.

The foot pillow 9 at the position b is used such that, when training for abdominal muscles is performed on the sleeping bed 1, the tips of the toes or the insteps of the feet are held by it or, when an exercise (movement) of curving the body backwardly is performed, the back or the waist is placed on it.

On the other hand, the foot pillow 9 at the position a is used to receive the heels when the trainee lies with the face turned upward on the sleeping bed 1.

A composite training machine 13 for training the pectoralis major, the arms and other parts of the body of the trainee is mounted on the wall plate 3 adjacent which a head receiving side end portion 1*c* of the sleeping bed 1 is located.

The composite training machine 13 includes a casing 14 mounted on the wall plate 3, a pair of first levers 15 to be used for strengthening of the upper half of the body including the pectoralis major and so forth, and a pair of second levers 16 to be used for strengthening of the arms and so forth.

A seat plate 17 is mounted on the front of the casing 14 for pivotal opening and closing movement over an angular range of substantially 90 degrees around a lower end portion of the front of the casing 14. The seat plate 17 is used such that, when it is at its open position received substantially horizontally on the sleeping bed 1, the trainee is seated on it with the upper half of the body erected upright as shown by alternate long and short dashes lines in FIG. 3 or the back of the trainee is received on it with the face turned upward as shown by alternate long and two short dashes lines in FIG. 3. When the seat plate 17 is not used, it can be held at its closed position shown in FIG. 1.

The first levers 15 are mounted for individual horizontal pivotal motion on an upper face of the casing 14 and have rather soft pads 15*a* mounted at free ends thereof. A pair of load elements such as coil springs not shown are located in the casing 14 and individually apply predetermined loads to the first levers 15 when the first levers 15 are pivoted by the trainee.

Figure 3:
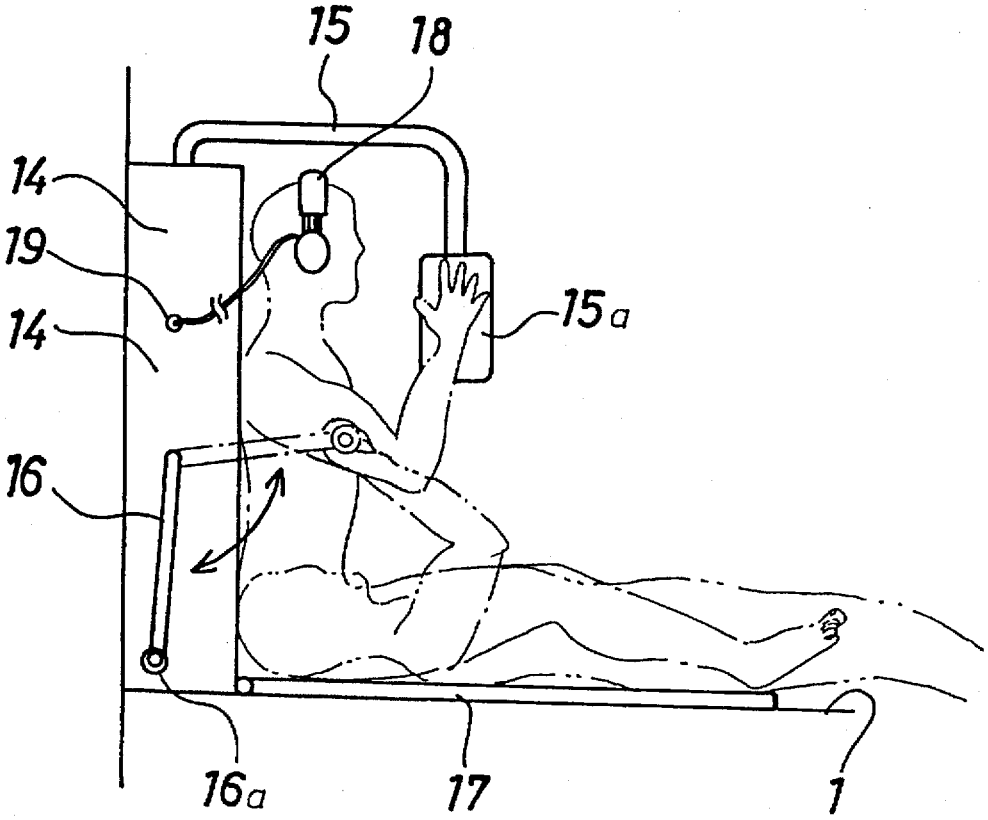
FIG. 3 is a side elevational view showing a composite training machine in use in the training room serving also as a bed room shown in FIG. 1.

When the first levers 15 are to be used, the trainee will pivot the seat plate 17 to the horizontal open position on the sleeping bed 1 as seen in FIG. 3 and be seated on the seat plate 17 in a posture with the back thereof supported on the front of the casing 14. Then, the inner sides of the hands or the arms will be applied to the pads 15*a* and the trainee will perform an exercise of pivoting the first levers 15 from their open positions shown in FIG. 1 toward their closed positions shown in FIG. 3 against the loads applied to the first levers 15.

The second levers 16 are mounted for individual vertical pivotal motion on the opposite side faces of the casing 14 and have horizontally bent grips 16*a* provided at free ends thereof. Further, predetermined loads are applied, when the second levers 16 are pivoted, to the second levers 16 individually by a pair of load elements such as coil springs not shown which are located in the casing 14.

When the second levers 16 are to be used, the trainee will pivot the seat plate 17 to the horizontal open position shown in FIG. 3 and lie at the back on the seat plate 17 with the face turned upward similarly as described above. Then, the trainee will grasp the grips 16*a* and perform an exercise of pivoting the second levers 16 upwardly from their positions indicated by solid lines in FIG. 3 against the loads applied to the second levers 16 by the load elements.

A jack 19 for a headphone 18 is provided on a side face of the casing 14 so that sound or music from an audio/visual apparatus such as a video apparatus which will be hereinafter described can be enjoyed by the trainee during training or during sleep.

A leg training machine 20 is mounted on the wall plate 5 adjacent which the leg receiving side end portion 1*b* of the sleeping bed 1 is located.

The leg training machine 20 includes a pair of cylinders 22 mounted on the wall plate 5 by way of universal couplings 21, a load element (not shown) such as an air spring or a coil spring accommodated in each of the cylinders 22, a pair of rods 23 having inner ends individually connected to the load elements, and a pair of foot mounting portions 24 secured to outer ends of the rods 23. Each of the foot mounting portions 24 includes a pedal 24*a* which includes a foot instep receiving belt 24*b* and a heel receiver 24*c*.

Figure 2:
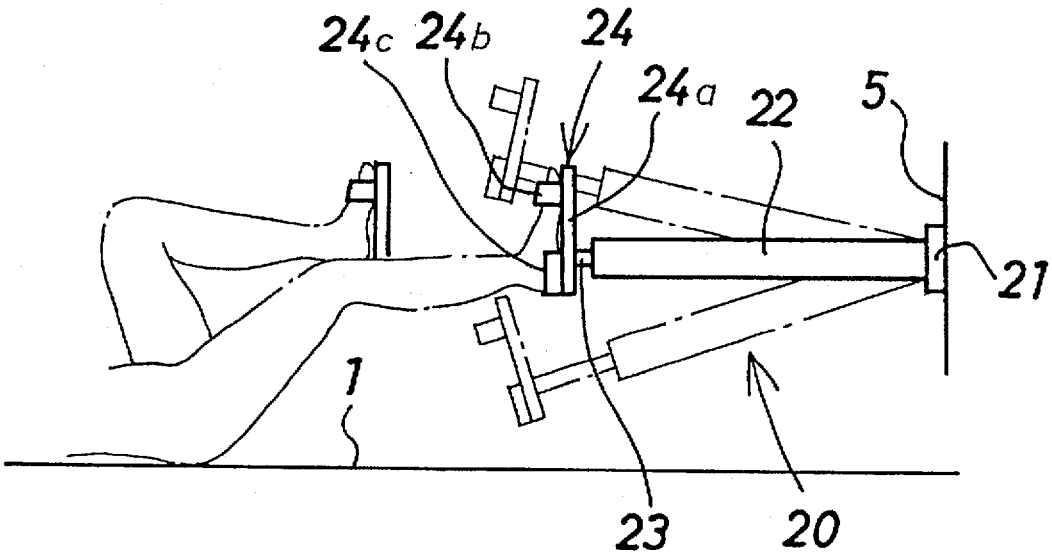
FIG. 2 is a side elevational view showing a leg training machine in use in the training room serving also as a bed room shown in FIG. 1.

When the leg training machine 20 is to be used, the trainee will lie with the face turned upwardly on the sleeping bed 1 as seen in FIG. 2 and, in this posture, the feet will be fitted into the foot instep receiving belts 24*b* so as to be fixed to the foot mounting portions 24. Then, the trainee will perform movements of alternately extending and contracting the left and right legs. By the movements, the load elements in the cylinders 22 are extended and contracted, and the resilient forces of the load elements upon such extending and contacting movements act as loads to the legs.

Further, as a result of the movements, the cylinders 22 are rocked upwardly and downwardly as indicated by alternate long and short dashed lines in FIG. 2. Accordingly, the trainee performs movements similar to pedaling movements of a bicycle. Consequently, the legs can be trained while the trainee is in a posture in which he or she lies on the sleeping bed 1, and the functions of the heart and the lungs can be strengthened simultaneously.

It is to be noted that the cylinders 22 may alternatively be mounted on the wall plate 5 so that they may be rocked only in vertical directions.

A back muscle training machine 25 is located between the cylinders 22 of the leg training machine 20.

The back muscle training machine 25 includes a take-up apparatus 28 mounted on the wall plate 5 and having a load element not shown, a wire 27 wound at a base end portion thereof on the take-up apparatus 28, and a handle bar 26 attached to the other end of the wire 27.

When the back muscle training machine 25 is to be used, the trainee will grasp, in a posture wherein the upper half rises uprightly on the sleeping bed 1, the handle bar 26 with the two hands and perform movements of forcing the handle bar 26 toward each other. The muscles of the back can be strengthened by the loads to the wire 27 which is fed out upon such movements.

A television monitor 29 and several other audio/visual apparatus such as a tuner, an amplifier and a video deck not shown are mounted on the wall plate 5 above the leg training machine 20. The television monitor 29 is mounted on the wall plate 5 in an inclined condition such that the trainee can visually observe the screen of the television monitor 29 while he or she is in a posture wherein he or she lies on the sleeping bed 1 or the upper half of his or her body rises upwardly.

Accordingly, for example, by reproducing a lesson video tape for training to be performed subsequently or a video tape for image training prior to starting of training, the training effect can be raised. Further, reproduced sound in this instance can be heard from the headphone 18 provided for the composite training machine 13.

A hanging down bar 30 is mounted on the ceiling plate 7 so that a stretching exercise for stretching a muscle, a tendon or the like can be performed using the hanging down bar 30.

With the training room A serving also as a bed room having the construction described above, suitable training can be performed on the sleeping bed 1 using the various training machines and then sleep immediately after completion of the training.

The training room A serving also as a bed room described above may additionally include various other equipment such as, for example, those described below.

1. A tanning lamp is provided on the ceiling plate or a wall plate.

2. An air conditioner for conditioning the temperature in the room is provided.

3. A massage machine for accelerating recovery from fatigue is provided.

Having now fully described the invention, it will be apparent to one of ordinary skill in the art that many changes and modifications can be made thereto without departing from the spirit and scope of the invention as set forth herein.

What is claimed is:

1. A physical strength training room also serving as a bedroom, comprising:

a housing including a floor plate, a plurality of wall plates, and a ceiling plate;

a sleeping bed provided within said housing, the sleeping bed being disposed so that a head receiving side end portion thereof, and a leg receiving side end portion thereof, both abut said wall plates wherein, said housing defines a space within which said sleeping bed is accommodated; and a plurality of physical strength training machines provided proximate to said head receiving side end portion of said sleeping bed, and at said leg receiving side end portion of said sleeping bed;

wherein said user can selectively use said physical strength training machines while the user is at least one of lying on said sleeping bed with the face turned upwardly, and seated on said sleeping bed, to thereby permit physical strength training to be performed immediately prior to sleeping; and wherein said physical strength training machines include an abdominal muscle training foot pillow provided at said leg receiving side end portion of said sleeping bed for movement between a position in which said foot pillow is received on an offset portion formed projectingly on the outer side of said leg receiving side end portion of said sleeping bed and is flush with an upper face of said sleeping bed and another position in which said foot pillow is received on the upper face of said leg receiving side end portion of said sleeping bed.

2. A physical strength training room also serving as a bedroom, comprising:

a housing including a floor plate, a plurality of wall plates, and a ceiling plate;

a sleeping bed provided within said housing, the sleeping bed being disposed so that a head receiving side end portion thereof, and a leg receiving side end portion thereof, both abut said wall plates wherein, said housing defines a space within which said sleeping bed is accommodated; and a plurality of physical strength training machines provided proximate to said head receiving side end portion of said sleeping bed, and at said leg receiving side end portion of said sleeping bed;

wherein said user can selectively use said physical strength training machines while the user is at least one of lying on said sleeping bed with the face turned upwardly, and seated on said sleeping bed, to thereby permit physical strength training to be performed immediately prior to sleeping; and wherein said physical strength training machines include a composite training machine for training the arms or other parts of the body of a user mounted on one of said wall plates which is located adjacent said head receiving side end portion of said sleeping bed, said composite training machine including a casing, a pair of first levers mounted for horizontal pivotal motion on said casing and each exerting, when pivoted artificially, a load to the pivoting movement, and a pair of second levers mounted for vertical pivotal motion on said casing and each exerting, when pivoted artificially, a load to the pivoting movement.

3. A physical strength training room also serving as a bedroom, comprising:

a housing including a floor plate, a plurality of wall plates, and a ceiling plate;

a sleeping bed provided within said housing, the sleeping bed being disposed so that a head receiving side end portion thereof, and a leg receiving side end portion thereof, both abut said wall plates wherein, said housing defines a space within which said sleeping bed is accommodated; and a plurality of physical strength training machines provided proximate to said head receiving side end portion of said sleeping bed, and at said leg receiving side end portion of said sleeping bed;

wherein said user can selectively use said physical strength training machines while the user is at least one of lying on said sleeping bed with the face turned upwardly, and seated on said sleeping bed, to thereby permit physical strength training to be performed immediately prior to sleeping; and wherein said physical strength training machines include a leg training machine mounted on one of said wall plates which is located adjacent said leg receiving side end portion of said sleeping bed, said leg training machine including a pair of cylinders mounted on said wall plate by way of a pair of respective universal couplings, a pair of rods individually received for axial movement in said cylinders and each exerting, when artificially moved axially, a load to the axial movement, and a pair of foot mounting portions individually secured to outer ends of said rods.

4. A physical strength training room also serving as a bedroom, comprising:

a housing including a floor plate, a plurality of wall plates, and a ceiling plate;

a sleeping bed provided within said housing, the sleeping bed being disposed so that a head receiving side end portion thereof, and a leg receiving side end portion thereof, both abut said wall plates wherein, said housing defines a space within which said sleeping bed is accommodated; and a plurality of physical strength training machines provided proximate to said head receiving side end portion of said sleeping bed, and at said leg receiving side end portion of said sleeping bed;

wherein said user can selectively use said physical strength training machines while the user is at least one of lying on said sleeping bed with the face turned upwardly, and seated on said sleeping bed, to thereby permit physical strength training to be performed immediately prior to sleeping; and wherein said physical strength training machines include a back muscle training machine mounted on one of said wall plates which is located adjacent said leg receiving side end portion of said sleeping bed, said back muscle training machine including a take-up apparatus mounted on said wall plate, a wire wound at a base end portion thereof on said take-up apparatus and exerting, when artificially unwound, a load to the unwinding movement, and a handle bar attached to the other end of said wire.

5. The physical strength training room serving also as a bed room as claimed in any one of claims 1 to 4, further comprising an audio/visual apparatus for image training located in said space.

* * * * *